US009836005B2

(12) United States Patent
Nakamura

(10) Patent No.: US 9,836,005 B2
(45) Date of Patent: Dec. 5, 2017

(54) SHEET FEEDING APPARATUS, SHEET FEEDING METHOD AND IMAGE FORMATION SYSTEM

(71) Applicant: Konica Minolta, Inc., Tokyo (JP)

(72) Inventor: Hajime Nakamura, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/251,611

(22) Filed: Aug. 30, 2016

(65) Prior Publication Data

US 2017/0060067 A1 Mar. 2, 2017

(30) Foreign Application Priority Data

Sep. 2, 2015 (JP) ..... 2015-172803

(51) Int. Cl.

| | |
|---|---|
| ***B65H 5/08*** | (2006.01) |
| ***G03G 15/00*** | (2006.01) |
| ***B65H 3/12*** | (2006.01) |
| ***B65H 7/00*** | (2006.01) |
| ***B65H 3/48*** | (2006.01) |
| ***B65H 5/22*** | (2006.01) |

(52) U.S. Cl.

CPC ..... *G03G 15/6529* (2013.01); *B65H 3/128* (2013.01); *B65H 3/48* (2013.01); *B65H 5/224* (2013.01); *B65H 7/00* (2013.01); *G03G 15/6511* (2013.01); *B65H 3/12* (2013.01); *B65H 2301/44735* (2013.01); *B65H 2406/323* (2013.01); *G03G 2215/004* (2013.01); *G03G 2215/00396* (2013.01); *G03G 2215/0135* (2013.01)

(58) Field of Classification Search

CPC ..... B65H 3/12; B65H 3/128; B65H 5/224; B65H 5/085; B65H 29/242; B65H 2301/44735; B65H 2406/323

See application file for complete search history.

(56) References Cited

U.S. PATENT DOCUMENTS 6,402,134 B1 * 6/2002 Gauger ..... B65H 3/0825 271/10.06
2012/0049437 A1 * 3/2012 Matsumoto ..... B65H 3/128 271/11

FOREIGN PATENT DOCUMENTS

JP 06-009083 A 1/1994
JP 09-216750 A 8/1997
(Continued)

OTHER PUBLICATIONS

Notice of Reasons for Rejection dated Sep. 12, 2017 from corresponding Japanese Patent Application No. JP 2015-172803 and English translation.

*Primary Examiner* — Howard Sanders
(74) *Attorney, Agent, or Firm* — Lucas & Mercanti, LLP

(57) ABSTRACT

A sheet feeding apparatus includes: a second conveyance belt disposed on an upstream side of a first conveyance belt in a sheet conveyance direction; a second absorption section configured to absorb the sheet stored in the sheet storage section to suck the sheet on the second conveyance belt; and a control section configured to perform a stopping operation for stopping at least one of a conveyance operation of the second conveyance belt and an absorption operation of the second absorption section during a conveyance operation of the first conveyance belt.

13 Claims, 11 Drawing Sheets

(56) References Cited

FOREIGN PATENT DOCUMENTS

| | | | |
|---|---|---|---|
| JP | 4952524 | B2 | 6/2012 |
| JP | 2014-152023 | A | 8/2014 |

* cited by examiner

SHEET FEEDING APPARATUS, SHEET FEEDING METHOD AND IMAGE FORMATION SYSTEM

CROSS REFERENCE TO RELATED APPLICATIONS

This application is entitled to and claims the benefit of Japanese Patent Application No. 2015-172803, filed on Sep. 2, 2015, the disclosure of which including the specification, drawings and abstract is incorporated herein by reference in its entirety.

BACKGROUND OF THE INVENTION

1. Field of the Invention

The present invention relates to a sheet feeding apparatus, a sheet feeding method and an image formation system.

2. Description of Related Art

Conventionally, as a sheet feeding apparatus for supplying sheets to an image forming apparatus such as a copier and a printer, sheet feeding apparatuses of an air system have been known (see, for example, Japanese Patent Publication No. 4952524). As disclosed in Japanese Patent Publication No. 4952524, a sheet feeding apparatus of an air system (hereinafter referred to as "air sheet feeding apparatus") includes a sheet storage section, a suction conveyance section, a floating air blowing section, a separation air blowing section, an outlet roller section and the like.

The suction conveyance section includes an endless conveyance belt having a large number of absorption ports, and an air absorption section installed inside the conveyance belt. The suction conveyance section is disposed above the sheet storage section. The suction conveyance section sucks, on the conveyance belt, sheets one by one from the sheet bundle loaded in the sheet storage section, and conveys the sheets. The floating air blowing section applies air to the sides of the sheet bundle from a direction orthogonal to the sheet conveyance direction (from the both ends of the sheet width direction) so as to float several upper sheets of the sheet bundle. The separation air blowing section applies air to a plurality of sheets sucked on the conveyance belt from the downstream side in the sheet conveyance direction and separates only the uppermost sheet. The outlet roller section is disposed on the downstream side of the suction conveyance section in the sheet conveyance direction, and configured to further output the sheet conveyed by the suction conveyance section toward the downstream side.

In the air sheet feeding apparatus, only the uppermost sheet which has been separated by the air of the separation air blowing section is sucked on the conveyance surface (suction surface) of the conveyance belt by the air absorption section. When the conveyance belt travels in this state, the uppermost first sheet is conveyed.

However, when the length of the sheet (the length in the sheet conveyance direction: sheet length) is longer than the length of the conveyance surface of the conveyance belt in the sheet conveyance direction, the sheet exceeding the conveyance surface of the conveyance belt hangs, and the hanging first sheet and the second sheet make contact with each other. As the sheet length increases, the range of the hanging part increases, and the contacting range with the second sheet increases. As a result, the frictional resistance between sheets increases, thus causing overlapped-sheets feeding in which the second sheet is sent together with the first sheet. In the case where air is applied to the second sheet to prevent the overlapped-sheets feeding, when the intensity of the air jetting is too high, the rear end of the first sheet which is not sucked on the conveyance surface bounces (sheet bounce), and deviates from the guide. Consequently, the sheet makes contact with the upper side structures and the like, and sliding resistance is generated.

In view of this, a technique has been provided in which a suction conveyance section is provided over the entire sheet surface, and the suction is performed in accordance with the sheet length so as to prevent the sheet bounce. For example, Japanese Patent Application Laid-Open No. 6-9083 discloses a technique in which an air absorption section installed inside a conveyance belt has a shutter for opening and closing an absorption port provided on the upstream side and downstream side in the sheet conveyance direction, and the absorption port is appropriately opened and closed with the shutter to selectively suck the sheet located at a position on the upstream side or downstream side in the sheet conveyance direction on the conveyance surface of the conveyance belt, and convey the sheet. In addition, Japanese Patent Application Laid-Open No. 9-216750 discloses a technique in which a slide valve is opened or closed in accordance with the length of the conveyed sheet, and an absorption force is generated only at a downward position of the sheet so that the sheet does not bounce.

However, in the techniques disclosed in Japanese Patent Application Laid-Open No. 6-9083 and Japanese Patent Application Laid-Open No. 9-216750 in which the entirety of the sheet surface is sucked in accordance with the sheet length to prevent sheet bounce, when sending of the uppermost first sheet with the conveyance belt is started, the first sheet is sequentially ejected out from the rear end (upstream) side of the conveyance surface of the conveyance belt in the sheet conveyance direction, and the second sheet is sucked with the absorption force on the conveyance belt at the conveyance surface from which the first sheet is ejected. Consequently, when the conveyance belt travels, overlapped feeding of the second sheet and the first sheet is caused. As such, it is necessary to partially stop the suction with a shutter and the like, or, stop the absorption fan itself for the purpose of preventing the suction of the second sheet.

SUMMARY OF THE INVENTION

An object of the present invention is to provide a sheet feeding apparatus, a sheet feeding method and an image formation system which can prevent overlapped-sheets feeding.

To achieve the abovementioned object, a sheet feeding apparatus reflecting one aspect of the present invention includes: a sheet storage section configured to store a plurality of sheets; a first conveyance belt on which to suck the sheet stored in the sheet storage section, the first conveyance belt being disposed above the sheet storage section and configured to convey the sucked sheet in a sheet conveyance direction; a first absorption section configured to absorb the sheet stored in the sheet storage section to suck the sheet on the first conveyance belt; a second conveyance belt on which to suck the sheet stored in the sheet storage section, the second conveyance belt being disposed above the sheet storage section on an upstream side of the first conveyance belt in the sheet conveyance direction, and configured to convey the sucked sheet in the sheet conveyance direction; a second absorption section configured to absorb the sheet stored in the sheet storage section to suck the sheet on the second conveyance belt; and a control section configured to perform a stopping operation for stopping at least one of a conveyance operation of the second conveyance belt and an absorption operation of the second absorption section during a conveyance operation of the first conveyance belt.

Desirably, in the sheet feeding apparatus, the control section performs the stopping operation when a rear end of the sheet passes through a position of a front end of the second conveyance belt in the sheet conveyance direction.

Desirably, in the sheet feeding apparatus includes: a sheet rear end detection section configured to detect whether the rear end of the sheet passes through the position of the front end of the second conveyance belt. The control section performs the stopping operation when the sheet rear end detection section detects that the rear end of the sheet passes through the position of the front end of the second conveyance belt.

Desirably, in the sheet feeding apparatus, the control section performs the stopping operation when the control section determines that the rear end of the sheet passes through the position of the front end of the second conveyance belt based on a length of the sheet and a sending time of the sheet by the second conveyance belt.

Desirably, in the sheet feeding apparatus, a length of a conveyance surface of the second conveyance belt in the sheet conveyance direction is equal to or smaller than a length of a conveyance surface of the first conveyance belt in the sheet conveyance direction.

Desirably, in the sheet feeding apparatus, the control section moves the second conveyance belt and the second absorption section in accordance with a length of the sheet stored in the sheet storage section.

Desirably, in the sheet feeding apparatus, a space is provided between the first conveyance belt and the second conveyance belt in the sheet conveyance direction; and, after the sheet is sucked on the first conveyance belt by the first absorption section and the sheet is sucked on the second belt by the second absorption section, the control section performs an operation for setting a conveyance speed of the second conveyance belt to a speed higher than a conveyance speed of the first conveyance belt such that the sheet is deflected in the space.

Desirably, in the sheet feeding apparatus, the first conveyance belt includes a first curved part configured to protrude to the space side at a predetermined curvature, and the second conveyance belt includes a second curved part configured to protrude to the space side at a predetermined curvature, the sheet feeding apparatus further comprising: a third absorption section configured to absorb the sheet conveyed in the space to suck the sheet on the first curved part; and a fourth absorption section configured to absorb the sheet conveyed in the space to suck the sheet on the second curved part.

Desirably, in the sheet feeding apparatus further includes a blowing section configured to apply air to the sheet to deflect the sheet in the space.

Desirably, in the sheet feeding apparatus, the blowing section applies the air in a horizontal direction orthogonal to the sheet conveyance direction.

Desirably, in the sheet feeding apparatus, the control section performs the operation for setting the conveyance speed of the second conveyance belt to a speed higher than the conveyance speed of the first conveyance belt such that a deflection amount of the sheet in the space is changed in accordance with a length of the sheet stored in the sheet storage section.

Desirably, in the sheet feeding apparatus, the control section performs the operation for setting the conveyance speed of the second conveyance belt to a speed higher than the conveyance speed of the first conveyance belt such that a deflection amount of the sheet in the space is changed in accordance with a type of the sheet stored in the sheet storage section.

To achieve the abovementioned object, a sheet feeding method reflecting one aspect of the present invention includes: storing a plurality of sheets in a sheet storage section; absorbing by a first absorption section the sheet stored in the sheet storage section to suck the sheet on a first conveyance belt; absorbing by a second absorption section the sheet stored in the sheet storage section to suck the sheet on the second conveyance belt disposed on an upstream side of the first conveyance belt in the sheet conveyance direction; conveying by the first conveyance belt and the second conveyance belt the sheet sucked on the first conveyance belt and the second conveyance belt in the sheet conveyance direction; and stopping at least one of a conveyance operation of the second conveyance belt and an absorption operation of the second absorption section during a conveyance operation of the first conveyance belt.

To achieve the abovementioned object, an image formation system reflecting one aspect of the present invention includes: the above-mentioned sheet feeding apparatus; and an image forming apparatus connected with the sheet feeding apparatus and configured to form an image on a sheet fed from the sheet feeding apparatus.

DESCRIPTION OF THE PREFERRED EMBODIMENTS

Figure 1:
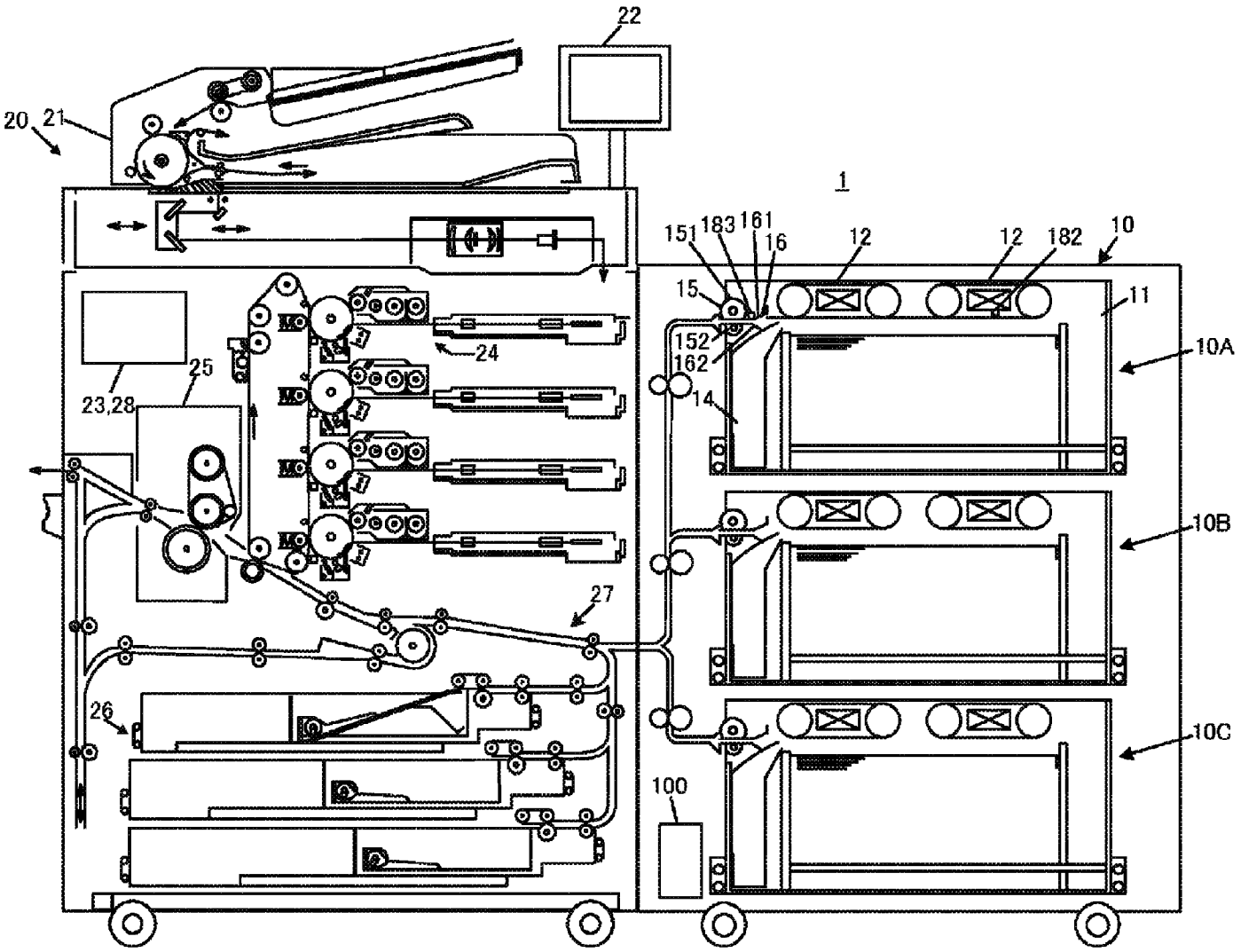
FIG. 1 illustrates a general configuration of an image formation system of an embodiment of the present invention.

In the following, an embodiment of the present invention is described in detail with reference to the accompanying drawings. FIG. 1 schematically illustrates a general configuration of image forming system 1 according to the embodiment of the present invention. As illustrated in FIG. 1, image formation system 1 has a configuration in which external large capacity sheet feeding apparatus 10 (hereinafter referred to as "sheet feeding apparatus 10") is connected to a lateral side (in FIG. 1, right side) of image forming apparatus 20.

Figure 2:
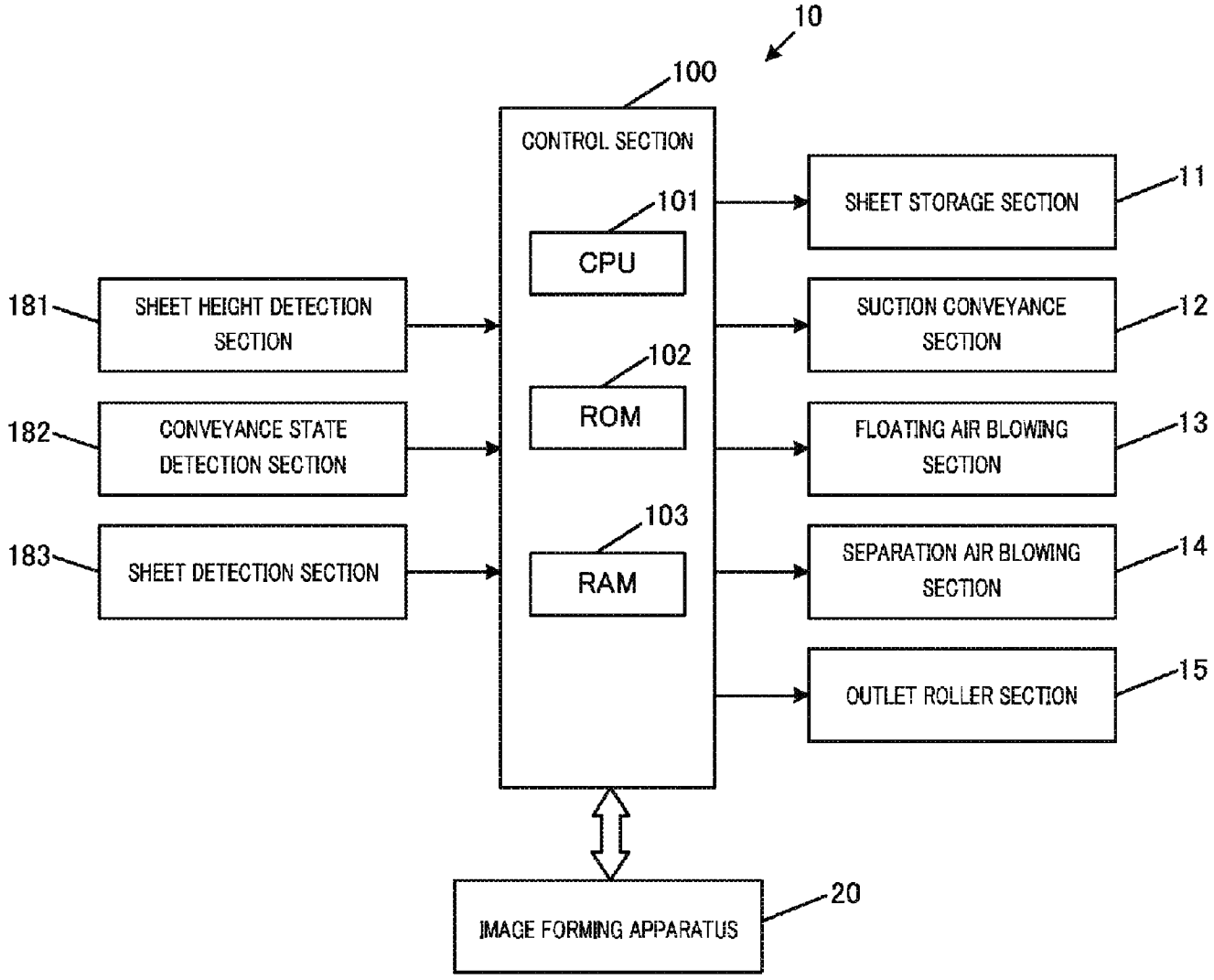
FIG. 2 illustrates a principal part of a control system of a sheet feeding apparatus of the embodiment of the present invention.

Sheet feeding apparatus 10 includes therein triple-stage sheet feed units 10A to 10C, and feeds sheets to image forming apparatus 20 one by one. As illustrated in FIG. 2, sheet feeding apparatus 10 includes control section 100 having central processing unit (CPU) 101, read only memory (ROM) 102, random access memory (RAM) 103 and the like. Control section 100 integrally controls an operation of each block of sheet feeding apparatus 10 in conjunction with control section 28 of image forming apparatus 20. To be more specific, control section 100 controls operations of sheet storage section 11, suction conveyance section 12, floating air blowing section 13, separation air blowing section 14, and outlet roller section 15 on the basis of a control signal from image forming apparatus 20, an input signal from sheet height detection section 181, conveyance state detection section 182, and sheet detection section 183 described later or the like. Details of sheet feed units 10A to 10C are described later.

Image forming apparatus 20 is a color-image forming apparatus of an intermediate transfer system using electrophotographic process technology. A longitudinal tandem system is adopted for image forming apparatus 20. In the longitudinal tandem system, respective photoconductor drums corresponding to the four colors of YMCK are placed in series in the travelling direction (vertical direction) of an intermediate transfer belt, and the toner images of the four colors are sequentially transferred to the intermediate transfer belt in one cycle. That is, image forming apparatus 20 transfers (primary-transfers) toner images of yellow (Y), magenta (M), cyan (C), and black (K) formed on the photoconductor drums to the intermediate transfer belt, and superimposes the toner images of the four colors on one another on the intermediate transfer belt. Then, image forming apparatus 20 transfers (secondary-transfers) the resultant image to a sheet, to thereby form an image.

Image forming apparatus 20 includes image reading section 21, operation display section 22, image processing section 23, image forming section 24, fixing section 25, sheet feeding section 26, sheet conveyance section 27, and control section 28.

Control section 28 includes a central processing unit (CPU), a read only memory (ROM), a random access memory (RAM) and the like. The CPU reads a program suited to processing contents out of the ROM, develops the program in the RAM, and integrally controls an operation of each block of image forming apparatus 20 in cooperation with the developed program. In addition, control section 28 controls the operation of sheet feeding apparatus 10 in conjunction with control section 100 of sheet feeding apparatus 10.

Image reading section 21 includes an auto document feeder (ADF), a document image scanning device (scanner) and the like. In image reading section 21, a document conveyed from the auto document feeder onto the contact glass or a document placed on the contact glass is read by the document image scanning device, and input image data is generated.

Operation display section 22 is composed of a liquid crystal display (LCD) with a touch panel, and functions as a display section and an operation section, for example.

Image processing section 23 performs on the input image data a digital image process such as a compression process, and various kinds of correction processes such as tone correction, color correction and shading correction in accordance with the initial setting or the user setting. Image forming section 24 is controlled on the basis of the image data that has been subjected to the above-mentioned processes.

Image forming section 24 forms images of colored toners of Y component, M component, C component, and K component on the basis of the image data. Image forming section 24 includes a photoconductor drum, a charging device, an exposing device, a developing device, and an intermediate transfer device. In image forming section 24, the surface of the photoconductor drum is uniformly charged by the charging device. The charged photoconductor drum is irradiated with laser light based on the image data by the exposing device, and thus an electrostatic latent image is formed on the surface of the photoconductor drum. Then, the photoconductor drum on which an electrostatic latent image is formed is supplied with toner by the developing device, and thus the electrostatic latent image is visualized to form a toner image. This toner image is transferred to a sheet by the intermediate transfer device having the intermediate transfer belt and the like.

Fixing section 25 includes an upper fixing section having a fixing side member disposed on a fixing surface (the surface on which a toner image is formed) side of a sheet, a lower fixing section having a back side supporting member disposed on the rear surface (the surface opposite to the fixing surface) side of a sheet, a heating source, and the like. The back side supporting member is brought into pressure contact with the fixing side member, whereby a fixing nip for conveying a sheet in a tightly sandwiching manner is formed. At the fixing nip, fixing section 25 applies heat and pressure to a sheet on which a toner image has been secondary-transferred to fix the toner image on the sheet.

Sheet feeding section 26 includes a plurality of (in FIG. 1, three) sheet feed trays. Sheets (standard type sheets and special type sheets) discriminated on the basis of their basis weight, size (such as the length and the width) and the like are stored in the sheet feed trays on a predetermined type basis.

Sheet conveyance section 27 conveys the sheet fed from sheet feeding section 26 or sheet feeding apparatus 10 to image forming section 24. At the time when the sheet passes through the secondary transfer section of image forming section 24, the toner image on the intermediate transfer belt is secondary transferred to one surface (front surface) of the sheet at a time, and a fixation process is performed at fixing section 25. The sheet on which an image has been formed is ejected out of the apparatus by a sheet ejection roller. In the case where images are formed on the both sides of a sheet, a sheet on which an image has been formed on one surface thereof is conveyed to a rear surface conveyance path, and then conveyed to image forming section 24 in an inverted state.

Figure 3:
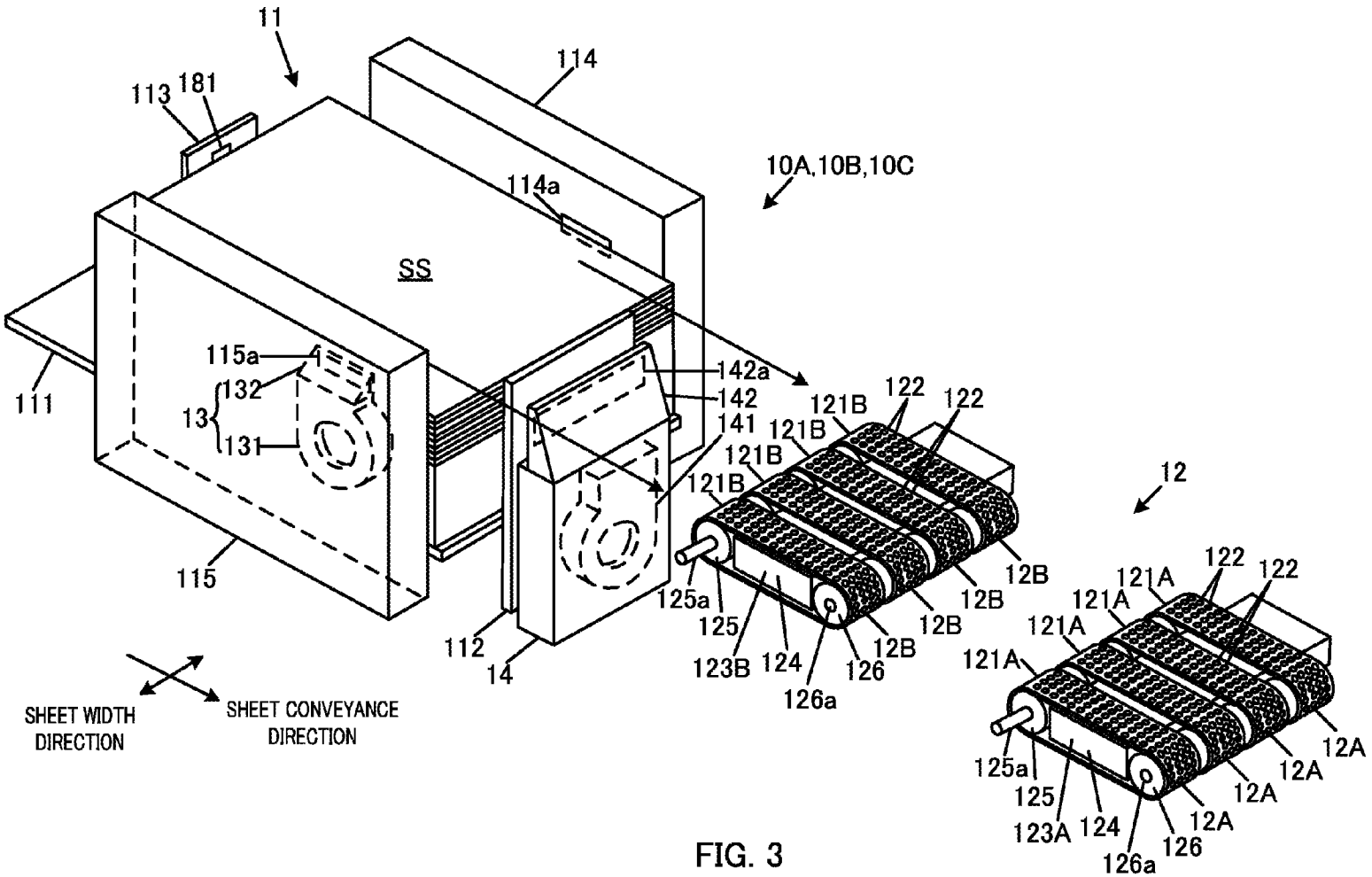
FIG. 3 is a perspective view illustrating a sheet feed unit which is a main part of the sheet feeding apparatus of the embodiment of the present invention.

Now sheet feed units 10A to 10C are described. FIG. 3 is a perspective view illustrating sheet feed units 10A to 10C which are a main part of sheet feeding apparatus 10. In FIG. 3, suction conveyance section 12 is shifted to the downstream side in the sheet conveyance direction. In the following, the "downstream side in the sheet conveyance direction" is also referred to as "front end side" or referred simply to as "downstream side," and the "upstream side in the sheet conveyance direction" is also referred to as "rear end side" or referred simply to as "upstream side."

As illustrated in FIG. 3, each of sheet feed units 10A to 10C includes sheet storage section 11, suction conveyance section 12, floating air blowing section 13, separation air blowing section 14, outlet roller section 15 (see FIG. 1), guide section 16 (see FIG. 1) and the like.

Sheet storage section 11 includes sheet stand 111, front end restriction member 112, rear end restriction member 113, and side end restriction members 114 and 115, and stores a large number of sheets. For example, 1,300 sheets are stored in sheet storage section 11 of sheet feed unit 10A, and 1,850 sheets are stored in each sheet storage section 11 of sheet feed units 10B and 10C, and in total, about 5,000 sheets are stored. Sheet storage section 11 can be drawn out from sheet feeding apparatus 10 with a guide rail (not illustrated). While sheet feed units 10A to 10C are different from each other in the number of stored sheets as described above, sheet feed units 10A to 10C have configurations substantially identical to each other. In the following description, sheet feed unit 10A is described as an example, and the description of sheet feed units 10B and 10C is omitted.

Sheet stand 111 is vertically movable such that the upper end surface (uppermost sheet) of sheet bundle SS placed thereon is always located at a predetermined position. At the time of replenishment of sheets, sheet stand 11 goes down to the lowermost position. The vertical movement operation of sheet stand 111 is controlled by control section 100. Front end restriction member 112 is fixed at the front end of sheet stand 111, and sets the position of the front end of sheet bundle SS.

Rear end restriction member 113 is configured to be movable in the sheet conveyance direction, and is disposed to conform to the sheet length of sheet bundle SS. Rear end restriction member 113 softly presses sheet bundle SS from the rear end side of sheet bundle SS to set the position of the rear end of sheet bundle SS. Rear end restriction member 113 has a height and a shape which always allow for the setting of the position of the rear end of the sheet even when the sheet is floated by air blow of floating air blowing section 13 or separation air blowing section 14.

Height detection section 181 is disposed at rear end restriction member 113. Height detection section 181 detects the height of the uppermost part of sheet bundle SS loaded on sheet stand 111. Control section 100 controls the vertical movement operation of sheet stand 111 on the basis of the detection result of sheet height detection section 181. Side end restriction members 114 and 115 are configured to be movable in the sheet width direction, and are disposed to conform to the sheet width of sheet bundle SS. Side end restriction members 114 and 115 softly press sheet bundle SS from the both sides in the sheet width direction to set the side end position of sheet bundle SS.

Side end restriction members 114 and 115 have a hollow structure, and floating air blowing section 13 is disposed inside side end restriction members 114 and 115. Air blow ports 114*a* and 115*a* for the air blowing from floating air blowing section 13 are provided at an upper part of the internal surface (which makes contact with sheet bundle SS) of side end restriction members 114 and 115. Air blow ports 114*a* and 115*a* are disposed such that air blow ports 114*a* and 115*a* at least partly overlap suction conveyance section 12 in the sheet conveyance direction.

Suction conveyance section 12 includes a plurality of suction conveyance sections 12A disposed side by side in the sheet width direction on the downstream side in the sheet conveyance direction, and a plurality of suction conveyance sections 12B disposed side by side in the sheet width direction on the upstream side in the sheet conveyance direction. Suction conveyance section 12 is disposed above sheet stand 111. Control section 100 individually controls suction conveyance section 12A and suction conveyance section 12B. To be more specific, depending on the position of the sheet being conveyed, suction conveyance section 12A and suction conveyance section 12B may simultaneously convey the same sheet, or suction conveyance section 12B may stop the conveyance of the next sheet while suction conveyance section 12A is conveying a sheet. These states are determined by conveyance state detection section 182 described later.

The relationships between the sheet length of sheet bundle SS (sheet length) loaded on sheet stand 111 and installation of suction conveyance sections 12A and 12B are as follows. The first case is a case where the leading end of the sheet exceeds the conveyance surface of conveyance belt 121B. The second case is a case where the leading end of the sheet falls within the range of the conveyance surface of conveyance belt 121B. The third case is a case where the leading end of the sheet does not reach the conveyance surface of conveyance belt 121B of suction conveyance section 12B (described later). The first case will be mainly described below, and, regarding the second and third cases, the configurations different from the first case will be described.

Suction conveyance section 12A disposed on the downstream side and suction conveyance section 12B disposed on the upstream side have configurations substantially identical to each other. Suction conveyance section 12A will be described below as an example, and, regarding suction conveyance section 12B, the configurations different from those of suction conveyance section 12A will be mainly described.

Suction conveyance section 12A includes endless conveyance belt 121A (which corresponds to "first conveyance belt" of the embodiment of the present invention) and air absorption section 123A (which corresponds to "first absorption section" of the embodiment of the present invention) disposed inside conveyance belt 121A.

Conveyance belt 121A is provided with a large number of absorption ports 122 over the entire surface thereof. Conveyance belt 121A is wound around roller 125 provided on the upstream side of air absorption section 123A in sheet conveyance direction, and roller 126 provided on the downstream side of air absorption section 123A in the sheet conveyance direction. Rollers 125 and 126 are formed in a drum shape (crown shape) for the purpose of preventing the lateral shifting of conveyance belt 121A wound on the rollers 125 and 126. Furthermore, rollers 125 and 126 may have flanges at the peripheries of the both end portions in the axis direction. Roller 126 rotates to follow the travelling of conveyance belt 121A. The sheet conveyance surface of conveyance belt 121A is a horizontal surface.

A plurality of rollers 125 corresponding to a plurality of conveyance belts 121A are provided, and attached on common roller shaft 125*a*. Roller shaft 125*a* is connected with a drive motor through a power transmission mechanism (not illustrated). When the drive motor is driven into rotation by control section 100, rollers 125 rotate and conveyance belts 121A travel in a certain direction.

A plurality of rollers 126 corresponding to a plurality of conveyance belts 121A are provided, and are attached on common roller shaft 126*a*.

Air absorption section 123A includes absorption duct 124 and an absorption fan (not illustrated). Absorption duct 124 extends through conveyance belts 121A toward the depth side of the device, and has on the bottom surface thereof absorption ports disposed at positions corresponding to conveyance belts 121A. The absorption fan is disposed at the deepest position of absorption duct 124. When the absorption fan operates, the internal pressure of absorption duct 124 becomes negative, and a sheet is absorbed toward conveyance belt 121A through absorption port 122 and sucked on conveyance belt 121A. The operation of the absorption fan is controlled by control section 100.

Subsequently, the configurations of suction conveyance section 12B different from those of suction conveyance section 12A will be mainly described. Sheet feeding apparatus 10 includes a sheet rear end detection section configured to detect a passing of the rear end of a sheet through conveyance belt 121B of suction conveyance section 12B on the upstream side in the sheet conveyance direction (which corresponds to "second conveyance belt" of the embodiment of the present invention"). The sheet rear end detection section is disposed at a position between the front end (downstream end) and the rear end (upstream end) of the conveyance surface (suction surface) of conveyance belt 121B, and detects suction of a second sheet (which is a sheet conveyed next to the uppermost sheet of sheet bundle SS placed on sheet stand 111) by the air absorption section 123B (which corresponds to "second absorption section" of the embodiment of the present invention) immediately after the rear end of a first sheet (which is the uppermost sheet) passes through that position. Accordingly, the position where the sheet rear end detection section is disposed is a position where suction of the second sheet is started, on the most upstream side in the region from the front end to the rear end of the conveyance surface of conveyance belt 121B. The position where the sheet rear end detection section is disposed is changed by the suction force of air absorption section 123B for the second sheet and the like. The position of the sheet rear end detection section is as follows, for example. In the case where suction of the second sheet is started immediately after the rear end of the first sheet passes through a center portion of the conveyance surface, the position of the sheet rear end detection section is located at a center portion of the conveyance surface. In the case where suction of the second sheet is started immediately after the first sheet has completely passed over the conveyance surface of conveyance belt 121B, the position of the sheet rear end detection section is located at the front end of the conveyance surface. In the case where suction of the second sheet is started immediately after the rear end of the first sheet has passed through the rear end of the conveyance surface of conveyance belt 121B, the position of the sheet rear end detection section is located at the rear end of conveyance surface.

In the present embodiment, the sheet rear end detection section is composed of conveyance state detection section 182 (see FIG. 1) configured to detect the conveyance state of a sheet on conveyance belt 121B, and includes a sensor. In conveyance state detection section 182, the sensor is disposed in the close proximity of a sheet sucked on second conveyance belt 121B at a position between conveyance belts 121B and 121B on the inner side of four conveyance belts 121B disposed side by side, for example. It is to be noted that a micro switch which turns on when a sensor (contact member) receives a contact pressure from a sheet and turns off when the contact pressure is not received is used for conveyance state detection section 182, for example.

Techniques of an optical mouse are applicable to conveyance state detection section 182, for example. That is, conveyance state detection section 182 includes a light emission section and a light reception section (image sensor) as a sensor, and detects the conveyance state (whether the sheet is being conveyed or stopped) of the sheet sucked on conveyance belt 121B on the basis of the variation between new and old image information obtained from reflection light from a sheet on the conveyance belt.

In addition, techniques of a mechanical mouse are applicable for conveyance state detection section 182, for example. In this case, conveyance state detection section 182 includes a rotational body (such as a roller and a ball, for example) as a sensor, and detects the conveyance state of the sheet sucked on conveyance belt 121B on the basis of the rotation of the rotational body.

Now, the detection timing of conveyance state detection section 182 will be described. When the rear end of the first sheet (the uppermost sheet of sheet bundle SS placed on sheet stand 111) has not passed through a position immediately below conveyance state detection section 182, the detection object is the first sheet, and therefore conveyance state detection section 182 detects that the sheet is being conveyed. On the other hand, after the rear end of the first sheet has passed through a position immediately below conveyance state detection section 182, the detection object is the second sheet, and therefore conveyance state detection section 182 detects that the sheet is stopped. That is, the timing when the detection result of conveyance state detection section 182 is changed from "conveyance" to "stop" is the timing when the rear end of the first sheet passes through a center portion of the conveyance surface of conveyance belt 121B and immediately before the second sheet is sucked on the second conveyance belt by air absorption section 123B, that is, an optimum timing for stopping the travelling of conveyance belt 121B. When the travelling of conveyance belt 121B is stopped at the above-mentioned timing, the second sheet sucked on conveyance belt 121B is not conveyed, and thus overlapped feeding of the second sheet and the first sheet can be prevented from occurring.

Floating air blowing section 13 includes air sending fan 131 and air introduction duct 132. Floating air blowing section 13 is disposed inside both of side end restriction members 114 and 115. FIG. 3 illustrates only floating air blowing section 13 disposed in side end restriction member 115. Air sending fan 131 can control the air volume on the basis of the sheet length, the sheet type, the basis weight and the like for example, and can send air with an optimum air volume. The operation of air sending fan 131 is controlled by control section 100.

Air introduction duct 132 of floating air blowing section 13 disposed inside side end restriction member 115 is communicated with air blow port 115*a*. An air introduction duct (not illustrated) of the floating air blowing section (not illustrated) disposed inside side end restriction member 114 is communicated with air blow port 114*a*. Floating air blowing section 13 is disposed inside side end restriction members 114 and 115, and therefore moves along with the movement of side end restriction members 114 and 115 when the sheet length is changed.

When air sending fan 131 operates in floating air blowing section 13, floating air is sent upward, and the direction of the floating air is changed by 90° at air introduction duct 132. Then, the floating air is sent from the both sides in the sheet width direction to the upper part of sheet bundle SS through blow ports 114*a* and 115*a*. Thus, several upper sheets of sheet bundle SS are floated.

Separation air blowing section 14 includes air sending fan 141 and air introduction duct 142. Separation air blowing section 14 is disposed on the downstream side of front end restriction member 112 in the sheet conveyance direction. Air sending fan 141 can control the air volume on the basis of the size (such as the length and the width), the sheet type, the basis weight and the like of the sheet, and can send air with an optimum air volume. The operation of air sending fan 141 is controlled by control section 100.

Separation air blowing section 14 may include a wind direction switching plate (not illustrated) such that air the air sending direction can be switched between the region around the front end of suction conveyance section 12A on the downstream side, and a region around the front end of sheet bundle SS. In this case, separation air blowing section 14 sends floating air to a region around the front end of sheet bundle SS when floating air is sent by floating air blowing section 13, and sends separation air to a region around the front end of suction conveyance section 12A when the floating air sent from floating air blowing section 13 is stopped. That is, separation air blowing section 14 also functions as a floating air blowing section.

When air sending fan 141 operates in separation air blowing section 14, air is sent to a region around the front end of sheet bundle SS or a region around the front end of suction conveyance section 12 through air blow port 142*a* of air introduction duct 142. By sending floating air to a region around the front end of sheet bundle SS, several upper sheets of sheet bundle SS can be efficiently floated. In addition, by sending separation air to a region around the front end of suction conveyance section 12, the second and subsequent sheets can be separated from the multiple sheets sucked on conveyance belt 121A, and thus only the first sheet can be conveyed by sucking the sheet on conveyance belt 121A.

Outlet roller section 15 includes upper conveyance roller 151 (see FIG. 1) and lower conveyance roller 152 (see FIG. 1) which makes contact with upper conveyance roller 151. Upper conveyance roller 151 is a driving roller, and lower conveyance roller 152 is a driven roller. Outlet roller section 15 sandwiches a sheet conveyed by suction conveyance sections 12A and 12B between upper conveyance roller 151 and lower conveyance roller 152, and sends the sheet toward the downstream side in the sheet conveyance direction.

Guide section 16 is disposed on the upstream side of output roller section 15 in the sheet conveyance direction. Guide section 16 includes upper side guide plate 161 (see FIG. 1) and lower side guide plate 162 (see FIG. 1), and guides a sheet conveyed by suction conveyance sections 12A and 12B to outlet roller section 15. A sheet is conveyed through a gap formed by upper side guide plate 161 and lower side guide plate 162.

Sheet detection section 183 (see FIG. 1) is disposed on the upstream side of output roller section 15 in the sheet conveyance direction. Sheet detection section 183 (so-called feed sensor) is composed of a reflection-type light sensor for example, and detects the presence and absence of a sheet on the basis of the intensity of received reflection light.

Figure 5:
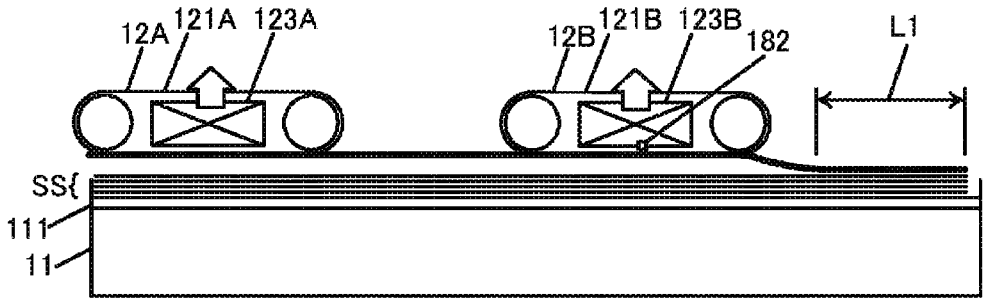
FIG. 5 schematically illustrates a sheet feed unit at the start of sheet conveyance.
Figure 6:
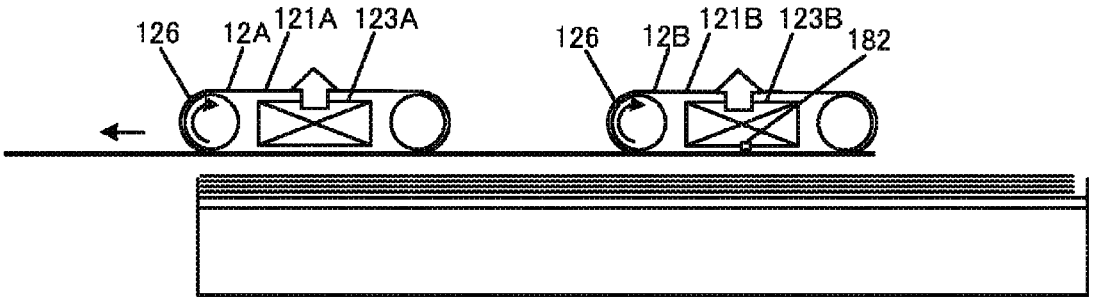
FIG. 6 schematically illustrates the sheet feed unit at a timing before a rear end of a sheet passes through a position of the conveyance surface of the conveyance belt.
Figure 7:
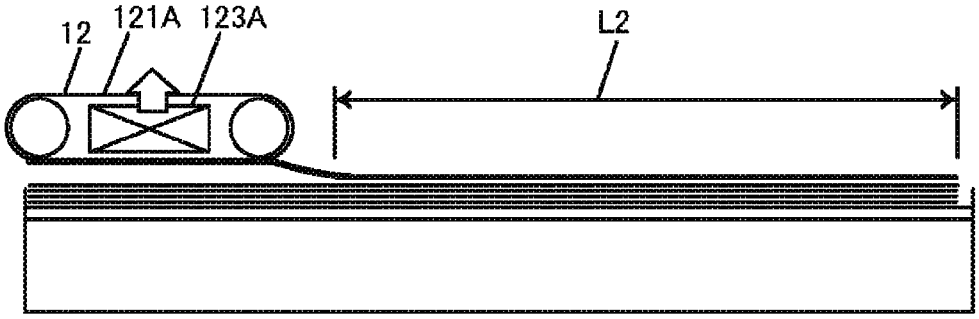
FIG. 7 illustrates a sheet which is sucked only on a downstream conveyance belt.
Figure 8:
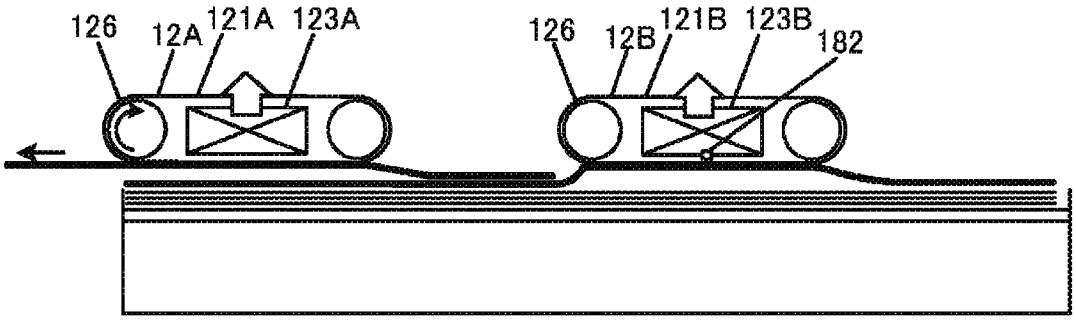
FIG. 8 schematically illustrates the sheet feed unit at a timing when a rear end of a sheet passes through a position of the conveyance surface of the conveyance belt.

Sheet conveyance states, and control of suction conveyance section 12A and suction conveyance section 12B will be described with reference to FIG. 5 to FIG. 8. FIG. 5 illustrates a state where the uppermost sheet (the first sheet) of sheet bundle SS placed on sheet stand 111 is sucked by suction conveyance section 12A and suction conveyance section 12B. FIG. 6 illustrates a state where suction conveyance section 12A and suction conveyance section 12B convey the first sheet. FIG. 7 illustrates a problem in a conventional conveyance device. FIG. 8 illustrates a state where suction conveyance section 12A conveys a first sheet, and suction conveyance section 12B sucks the next sheet (the second sheet).

In FIG. 5, length L1 indicates the length of the rear end of a hanging first sheet which is not sucked on downstream conveyance belt 121A and upstream conveyance belt 121B, and makes contact with the second sheet. Meanwhile, in FIG. 7, length L2 indicates a total length of an intermediate portion and a rear end portion of a hanging first sheet which is not sucked on downstream conveyance belt 121A, and makes contact with the second sheet. When a first sheet is conveyed, a frictional resistance is caused by the contact between the first and the second sheets. Length L1 of the contact between the first and the second sheets illustrated in FIG. 5 is considerably smaller than length L2 illustrated in FIG. 7, and therefore the frictional resistance at this time is small. Thus, overlapped feeding of the second sheet and the first sheet can be prevented from occurring. In addition, damaging of sheets due to friction can be prevented.

In the state illustrated in FIG. 5, the first sheet is sucked on suction conveyance section 12A and suction conveyance section 12B (first state). After the first state, suction conveyance section 12A and suction conveyance section 12B convey the sucked sheet as illustrated in FIG. 6 (second state). At this time, when the rear end of the sheet passes through conveyance state detection section 182, the travelling of conveyance belt 121B is stopped while the absorption of air absorption section 123B is continued (third state). In this state, when the sheet is completely removed from the rear end of suction conveyance section 12B (removed from air absorption section 123B), absorption of air absorption section 123B is still continued, and accordingly suction conveyance section 12A conveys the first sheet whereas suction conveyance section 12B sucks the second sheet on suction conveyance section 12B as illustrated in FIG. 8 (fourth state). In the fourth state, suction conveyance section 12A conveys the first sheet whereas suction conveyance section 12B sucks the second sheet on suction conveyance section 12B, and thus the first sheet and the second sheet can be surely separated from each other. In addition, the second sheet separated from the third sheet is sucked on suction conveyance section 12B, and therefore, when suction conveyance section 12A absorbs the second sheet after conveyance of the first sheet, the sheet is easily absorbed in comparison with absorption of a second sheet using the conventional suction conveyance section. As a result, the productivity is improved in terms of sheet conveyance.

Figure 4:
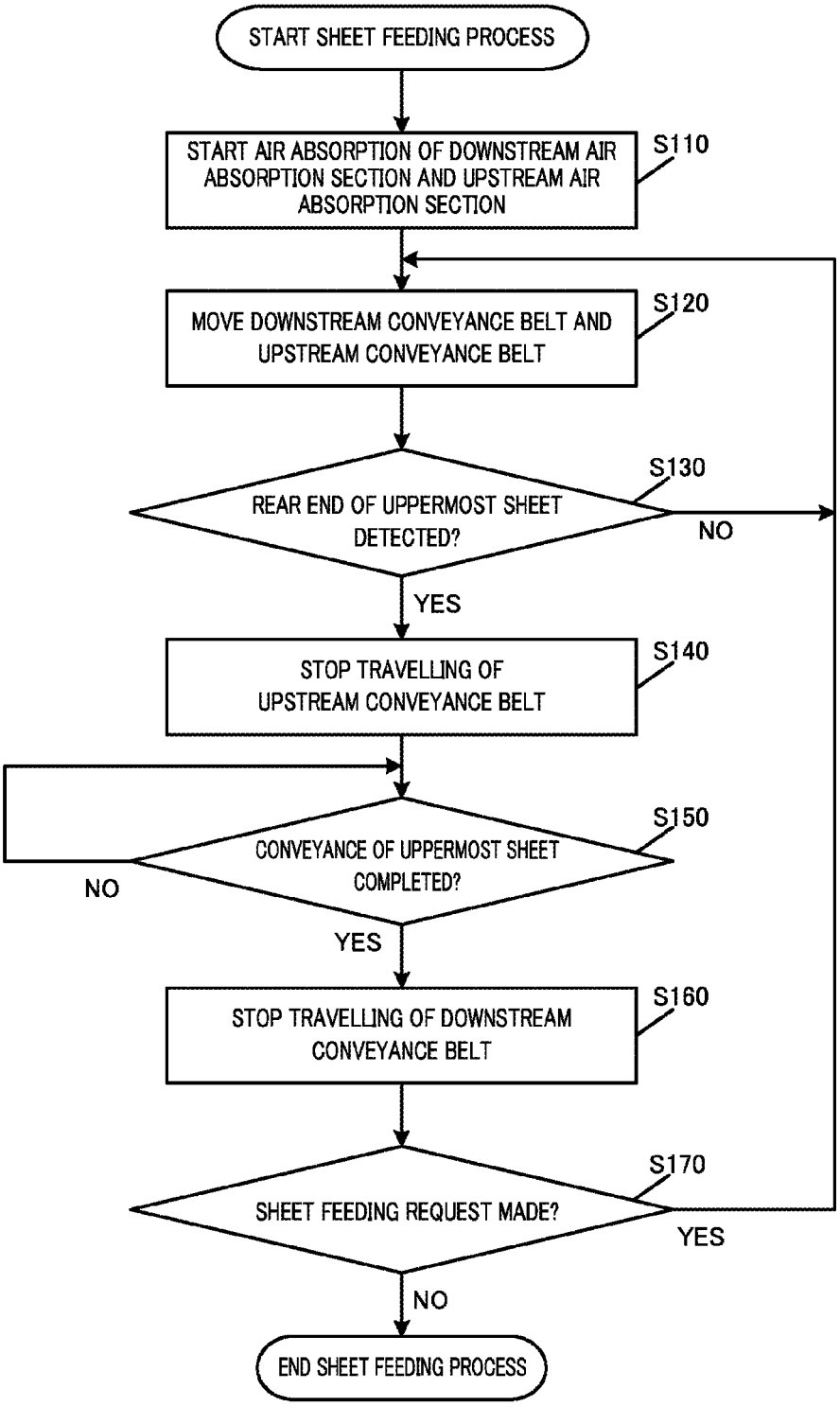
FIG. 4 is a flowchart of an exemplary sheet feeding process of the embodiment of the present invention.

FIG. 4 is a flowchart of an exemplary sheet feeding process in the present embodiment. The sheet feeding process illustrated in FIG. 4 is achieved when CPU 101 executes a predetermined program stored in ROM 102 in response to input of sheet feeding start information from image forming apparatus 20, for example. While sending and stopping of the floating air performed in the sheet feeding process are not mentioned here, several upper sheets of sheet bundle SS stored in sheet storage section 11 are floated against the own weight of the sheets by sending the floating air at an optimum timing. Likewise, while sending and stopping of the separation air performed in the sheet feeding process are not mentioned here, the second and subsequent sheets are separated from a plurality of sheets sucked on conveyance belt 121A by sending the separation air at an optimum timing. Further, the sheet length of the sheet to be fed is greater than the length of the conveyance surface of conveyance belt 121B.

At step S110, control section 100 controls downstream air absorption section 123A and upstream air absorption section 123B to start air absorption. Air absorption sections 123A and 123B perform air absorption at all times until the sheet feeding process is completed. As illustrated with outlined arrow in FIG. 5, with the air absorption, the uppermost first sheet is sucked on downstream conveyance belt 121A and upstream conveyance belt 121B (first state).

At step S120, control section 100 controls suction conveyance sections 12A and 12B to move conveyance belts 121A and 121B. Thus, the first sheet is conveyed in a state where it is sucked on conveyance belts 121A and 121B (second state). In FIG. 6, the travelling of conveyance belts 121A and 121B is illustrated with the arrow of the rotational direction of roller 126, and in addition, the conveyance of the first sheet is illustrated with the arrow of the sheet conveyance direction. It is to be noted that control section 100 performs an operation for starting the rotation of outlet roller section 15.

At step S130, control section 100 determines whether the first (uppermost) sheet has passed over the center portion of the conveyance surface of conveyance belt 121B on the basis of the detection result of conveyance state detection section 182. When conveyance state detection section 182 detects "conveyance" of a sheet (S130: NO), it can be determined that the rear end of the first sheet has not yet passed through the center portion of the conveyance surface. Accordingly, the process is returned to step S120, and control section 100 controls suction conveyance sections 12A and 12B to continue the travelling of conveyance belts 121A and 121B. When the detection result of conveyance state detection section 182 is changed from "conveyance" to "stop," (S130: YES), it can be determined that the rear end of the first sheet has passed over the center portion of the conveyance surface, and the process is advanced to step 140.

At step S140, control section 100 controls suction conveyance section 12B to stop the travelling of conveyance belt 121B (third state). The second sheet receives a force in the sheet conveyance direction due to the frictional resistance with the first sheet; however, since control section 100 controls suction conveyance section 12B to stop the travelling of conveyance belt 121B, the second sheet sucked on conveyance belt 121B does not move (fourth state). Thus, overlapped-sheets feeding can be prevented from occurring (see FIG. 8). In FIG. 8, the travelling of conveyance belt 121A is illustrated with the arrow of the rotational direction of roller 126, and stop of the travelling of conveyance belt 121B is represented by not showing the arrow of the rotational direction of roller 126.

Control section 100 controls suction conveyance section 12A to continue travelling of control conveyance belt 121A, and in addition, operates to continue the sheet ejection of outlet roller section 15. Thus, the first sheet is ejected to the downstream side in the sheet conveyance direction.

At step S150, control section 100 determines the presence and absence of the first sheet on the basis of the detection result of sheet detection section 183. When sheet detection section 183 detects the "presence" of first (uppermost) sheet (S150: NO), control section 100 again determines the presence and absence of the first sheet. When sheet detection section 183 detects the "absence" of the first sheet (S150: YES), the process is advanced to step S160.

At step S160, control section 100 controls suction conveyance section 12A to stop the travelling of conveyance belt 121A.

At step S170, control section 100 determines whether the sheet feeding request has been made on the basis of the sheet feeding information sent from image forming apparatus 20. When control section 100 determines that no sheet feeding request has been made (S170: NO), the sheet feeding process is ended. When control section 100 determines that a sheet feeding request has been made (S170: YES), the process is advanced to step S120.

In this manner, sheet feeding apparatus 10 of the present embodiment includes control section 100 that operates to stop the travelling of conveyance belt 121B when it is determined that the rear end of the sheet has passed over the center portion of the conveyance surface of conveyance belt 121B on the basis of the detection result of conveyance state detection section 182 during conveyance of the first (uppermost) sheet. When conveyance belt 121B is in a stopped state, the second sheet is sucked on conveyance belt 121B, and therefore, the movement of the second sheet is limited when the first sheet is conveyed. In this manner, overlapped-sheets feeding can be prevented from occurring.

In addition, during the conveyance of the first sheet, a part of the second sheet is sucked by upstream air absorption section 123B to perform the floating. Thus, the suction force between the second sheet and the third sheet is reduced, and by air absorption of downstream air absorption section 123A, floating of the second sheet is facilitated. As a result, the time until suction of the sheet on downstream conveyance belt 121A is reduced, and feeding of the second sheet can be immediately started, and consequently, the conveyance time of the second sheet can be reduced. In contrast, in the case of a sheet feeding apparatus having a conveyance belt of an entire surface suction type in which the conveyance surface (suction surface) is provided over the entire surface of the sheet, the feeding operation of the second sheet is started after the conveyance of the first sheet is completed. That is, in sheet feeding apparatus 10 of the present embodiment, the time for the conveyance of the second sheet can be reduced by starting the feeding operation of the second sheet during the conveyance of the first sheet, and therefore the productivity can be improved in comparison with the sheet feeding apparatus of the entire surface suction type.

Furthermore, in a conventional technique disclosed in Japanese Patent Application Laid-Open No. 6-9083, it is necessary to upsize the apparatus and additionally provide the air absorption section so that the air absorption section conforms to the maximum length of the sheet to be used. In addition, in view of using sheets ranging from a sheet such as a post card having a short length to a long sheet which is long in the sheet conveyance direction, the structure is complicated, and the number of components and the cost increase. In addition, in the conventional technique disclosed in Japanese Patent Application Laid-Open No. 9-216750, a slide valve corresponding to the length of the sheet to be conveyed is required, and consequently the number of components and the cost increase. In contrast, in the above-mentioned image formation system according to the embodiment, it is only necessary to dispose suction conveyance section 12A on the downstream side in the sheet conveyance direction and suction conveyance section 12B on the upstream side in the sheet conveyance direction, and it is not necessary to provide the suction conveyance section over the entirety of the surface of the sheet. Consequently, in comparison with the case of the conventional technique where the suction conveyance section and the slide valve are provided over the entirety of the surface of the sheet, the increase of the number of components and the cost can be suppressed.

The case (first case) where the leading end of the sheet (sheet length) exceeds the conveyance surface of conveyance belt 121B has been described above. In the case where the leading end of the sheet falls within the range of the conveyance surface of conveyance belt 121B (second case), the sheet can be conveyed as with the first case. It should be noted that, in the case where control section 100 controls air absorption sections 123A and 123B to suck the sheet on conveyance belts 121A and 121B, when the rear end of the sheet is located at a position downstream side of the center portion of the conveyance surface of conveyance belt 121B, control section 100 naturally controls suction conveyance section 12B to stop the travelling of conveyance belt 121B. In addition, in the case where the leading end of the sheet does not reach the conveyance surface of conveyance belt 121B of suction conveyance section 12B (third case), naturally, control section 100 controls air absorption section 123B to stop the air absorption, and control section 100 controls suction conveyance section 12B to stop the travelling of conveyance belt 121B.

It is desirable to set the positional relationship between suction conveyance section 12A and suction conveyance section 12B in consideration of the length of hanging without being sucked on upstream conveyance belt 121B (L1 of FIG. 5), and the length of hanging without being sucked on downstream conveyance belt 121A. To be more specific, the positions of suction conveyance section 12A and suction conveyance section 12B can be set in accordance with the length of the sheet storage section, and when the positions are set such that the length of the hanging without being sucked on upstream conveyance belt 121B and the length of the hanging without being sucked on downstream conveyance belt 121A are minimized, generation of the frictional resistance due to the contact between the first and the second sheets can be suppressed. In addition, since a sheet, which has been floated once by suction conveyance section 12, generates less frictional resistance due to the contact between the first and the second sheets in comparison with a sheet which has not been floated, it is possible to set the positions such that the length of the hanging without being sucked on upstream conveyance belt 121B is smaller than the length of the hanging without being sucked on downstream conveyance belt 121A.

Modification 1

Figure 9:
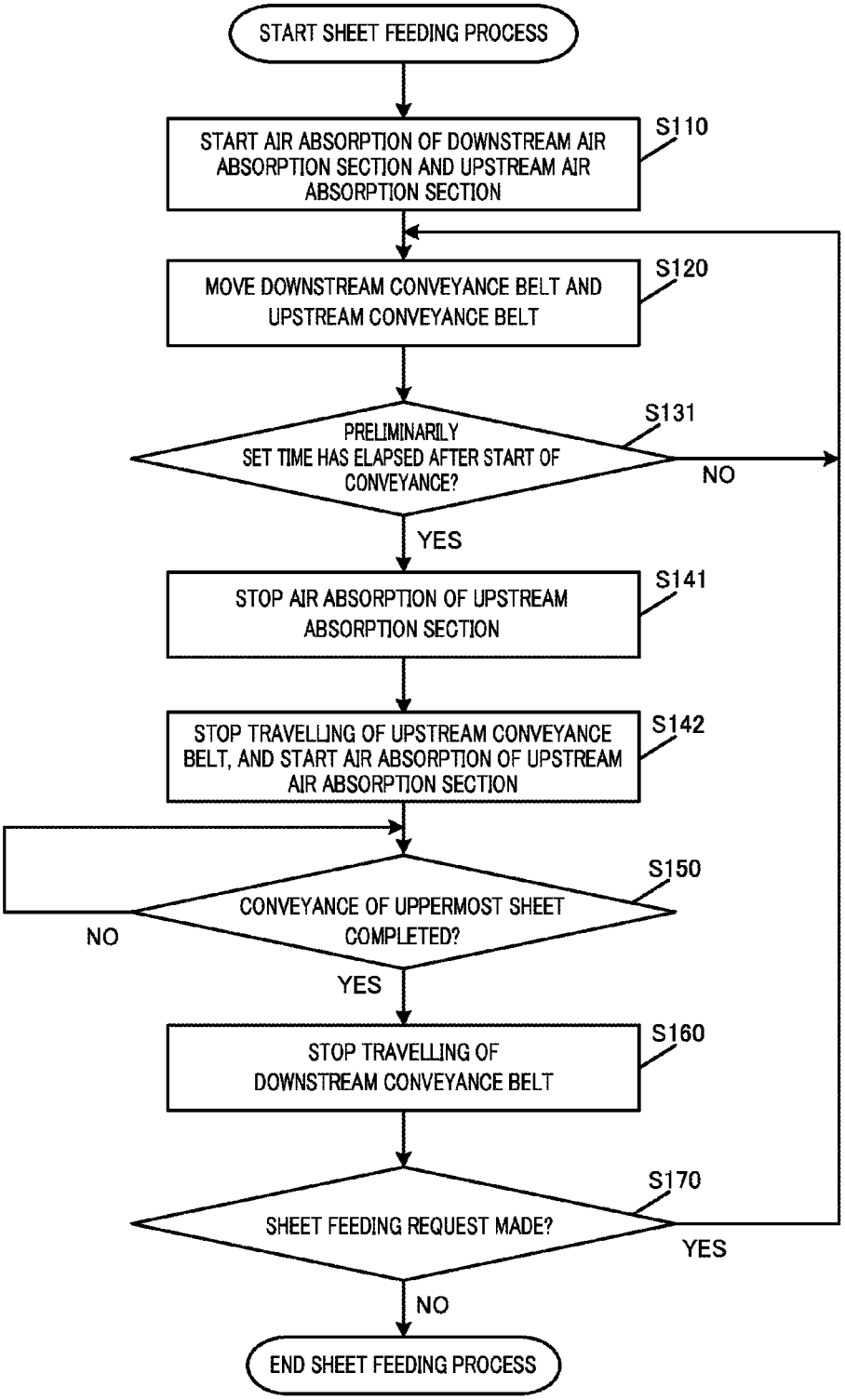
FIG. 9 is a flowchart of an exemplary sheet feeding process of modification 1.

FIG. 9 is a flowchart of an exemplary sheet feeding process of modification 1. In the sheet feeding process described in FIG. 9, processes different from the sheet feeding process of the above-mentioned embodiment described in FIG. 4 will be mainly described, and the steps in which the same processes are performed are denoted with the same reference numerals and the description thereof will be omitted.

In the above-mentioned embodiment, control section 100 determines whether the rear end of the sheet has passed through the center portion of the conveyance surface of conveyance belt 121B on the basis of the detection result of conveyance state detection section 182. In contrast, in modification 1, the determination is made on the basis of the sheet length and the sending time of the sheet by conveyance belt 121B. To be more specific, a timer (not illustrated) measures the time elapsed after the start of sheet conveyance (which corresponds to "sending time of the sheet by the second conveyance belt" of the embodiment of the present invention). A preliminarily set time based on the sheet length (sheet length) and the travelling speed of conveyance belt 121B (the sending speed of a sheet by conveyance belt 121B) is stored in an internal memory (not illustrated) of control section 100. Control section 100 reads out the preliminarily set time from the internal memory, and compares the preliminarily set time with the elapsed time measured with the timer to determine whether the rear end of the sheet has passed through the center portion of the conveyance surface.

At step S131, control section 100 determines whether the preliminarily set time has elapsed from the start of sheet conveyance. When control section 100 does not determine that the preliminarily set time has elapsed from the start of sheet conveyance (S131: NO), the process is advanced to step S120. When control section 100 determines that the preliminarily set time has elapsed from the start of sheet conveyance (S131: YES), the process is advanced to step S141.

Figure 10:
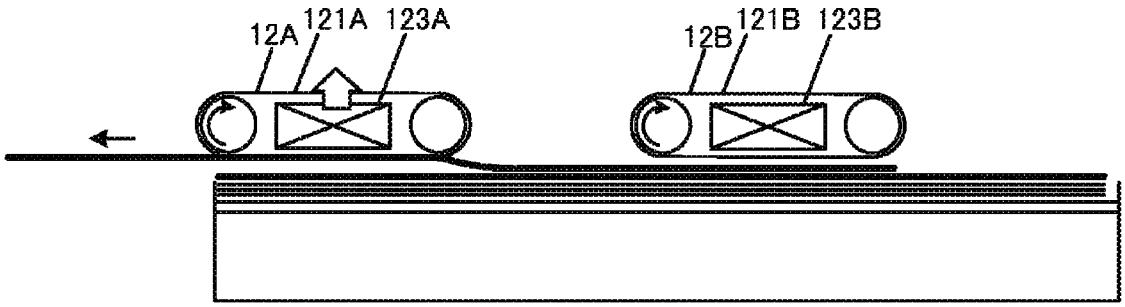
FIG. 10 schematically illustrates the sheet feed unit according to modification 1.

At step S141, control section 100 controls upstream air absorption section 123B to stop the air absorption (see FIG. 10). In FIG. 10, the stop of air absorption is indicated by not showing the outlined arrow at air absorption section 123B. Since the absorption force by air is reduced, the second sheet is not sufficiently sucked on conveyance belt 121B, or is separated from conveyance belt 121B by the own weight. As a result, the second sheet is not conveyed by the travelling of conveyance belt 121B, and thus overlapped-sheets feeding can be prevented from occurring.

Figure 11:
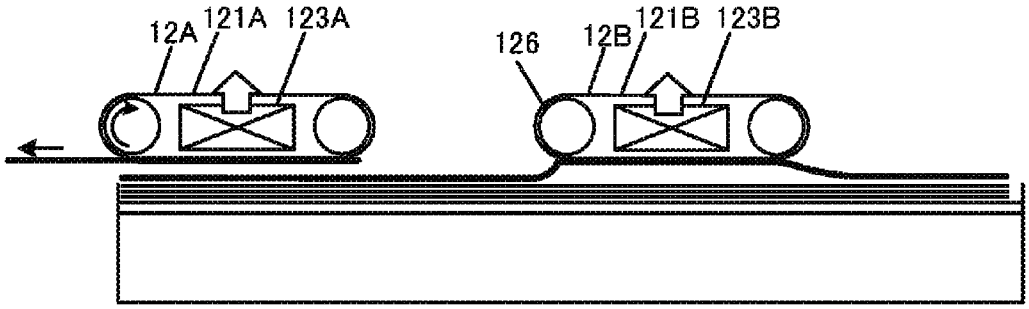
FIG. 11 schematically illustrates the sheet feed unit according to modification 1.

At step S142, control section 100 controls suction conveyance section 12B to stop the travelling of conveyance belt 121B, and, controls upstream air absorption section 123B to restart the air absorption (see FIG. 11). In FIG. 11, air absorption is indicated by showing the outlined arrow at air absorption section 123B, and a state where the travelling of conveyance belt 121B of stopped is indicated by not showing the arrow in the rotational direction of roller 126. It is to be noted that the timing at which the travelling of conveyance belt 121B is stopped, and, the air absorption is restarted may be a timing immediately after the air absorption is stopped at step S141, or may be a timing after a predetermined time has elapsed from the stop of the absorption, such as a timing at which the first sheet has completely passed over the conveyance surface of conveyance belt 121B, for example.

Since the air absorption is restarted during the conveyance of the first sheet to suck a part of the second sheet on conveyance belt 121B, productivity can be improved as with the above-mentioned embodiment.

Modification 2

Figure 12:
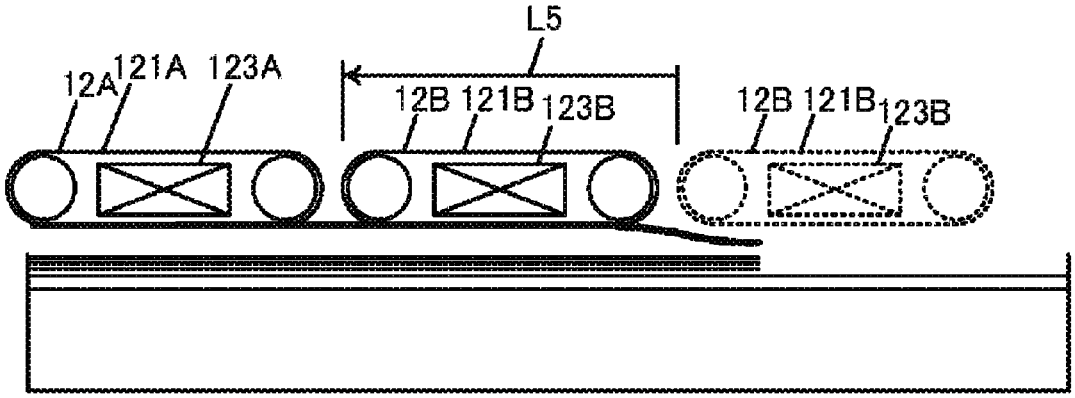
FIG. 12 schematically illustrates the sheet feed unit according to modification 2.

FIG. 12 schematically illustrates sheet feed units 10A to 10C according to modification 2. In modification 2, on the basis of information (included in sheet feeding information sent from image forming apparatus 20) on the length of the sheet stored in sheet storage section 11, control section 100 moves upstream conveyance belt 121B to a position in the sheet conveyance direction in accordance with the sheet length. It is to be noted that conveyance belt 121B is moved by moving the entirety of suction conveyance section 12B. Distance L5 in FIG. 12 indicates the movement length from the position of conveyance belt 121B before the movement illustrated by broken line to the position of conveyance belt 121B after the movement illustrated by solid line. Here, the "position in the sheet conveyance direction in accordance with the sheet length" is a position where the area (hanging total area) of the range in which a hanging part of the first sheet which is out of the conveyance surfaces of conveyance belts 121A and 121B (for example, a rear end portion or an intermediate portion of the sheet portion) makes contact with the second sheet is minimized. The position where the total area is minimized can be empirically determined on the basis of the sheet length, the basis weight, the type of the sheet, the length of the conveyance surface of conveyance belt 121B in the sheet conveyance direction and the like. The position where the total area is minimized is stored in coordination with the sheet length and the like in an internal memory (not illustrated) of control section 100. By minimizing the total area of the hanging, the frictional resistance between the first sheet and the second sheet is reduced, and a state where overlapped-sheets feeding is not easily generated can be established.

Modification 3

Figure 13:
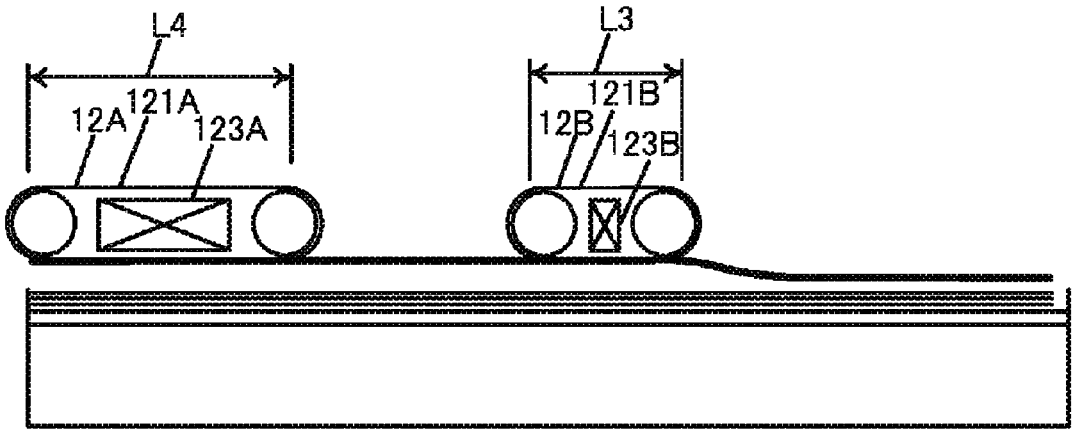
FIG. 13 schematically illustrates the sheet feed unit according to modification 3.

FIG. 13 schematically illustrates sheet feed units 10A to 10C according to modification 3. In modification 3, length L3 of the conveyance surface of conveyance belt 121B (suction surface) in sheet conveyance direction is smaller than length L4 of the conveyance surface of conveyance belt 121A (L3≤L4). By setting length L3 of the conveyance surface of conveyance belt 121B to a length smaller length L4 of the conveyance surface of conveyance belt 121A, downstream conveyance belt 121A can have a wide conveyance surface (suction surface) as the main force of the conveyance force in sheet conveyance. On the other hand, upstream conveyance belt 121B can have a narrow conveyance surface as an auxiliary force in the conveyance force. In addition, by reducing the length of the conveyance surface, the weight of suction conveyance section 12B is reduced, and, advantageously, suction conveyance section 12B can be easily moved. Further, by setting length L3 of the conveyance surface of conveyance belt 121B and length L4 of the conveyance surface of conveyance belt 121A to the same length, the conveyance belt and the like can be shared.

Modification 4

Figure 14:
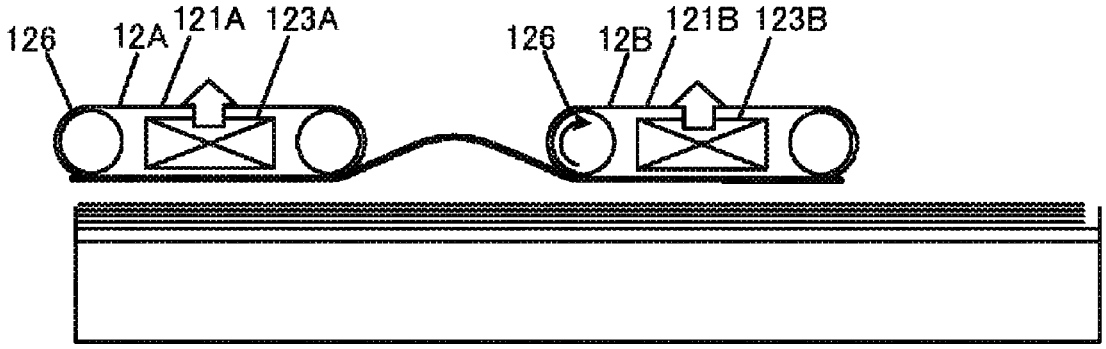
FIG. 14 schematically illustrates the sheet feed unit according to modification 4.
Figure 15:
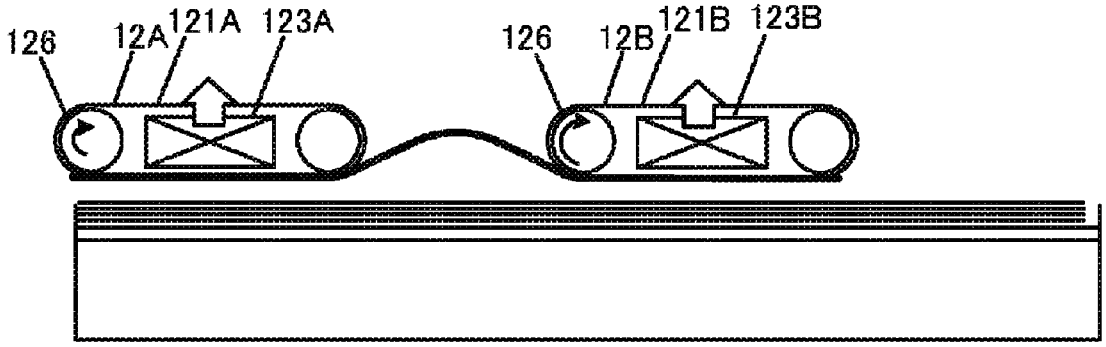
FIG. 15 schematically illustrates the sheet feed unit according to modification 4.

FIG. 14 and FIG. 15 schematically illustrate sheet feed units 10A to 10C according to modification 4.

In modification 4, control section 100 controls air absorption section 123A such that the front end side of a sheet is sucked on conveyance belt 121A, and in addition, controls air absorption section 123B such that the rear end side of a sheet is sucked on conveyance belt 121B. Further, control section 100 controls suction conveyance sections 12A and 12B such that the first sheet (for example, an intermediate portion thereof) is deflected in a direction opposite to the second sheet (that is, the upward direction) in a space between conveyance belts 121A and 121B in the sheet conveyance direction. Thus, the uppermost first sheet can be sufficiently separated from the second sheet, and separativeness can be improved, and, a state where overlapped-sheets feeding is not easily generated can be established. By deflecting an intermediate portion of a sheet, a rear end portion of the sheet is moved to the downstream side, and along with this movement, the hanging amount of the sheet hanging from the rear end of conveyance belt 121B is reduced. Also in this manner, a state where overlapped-sheets feeding is not easily generated can be established.

It is to be noted that the intermediate portion of the sheet is not required to be deflected in the case where the reading end of the sheet does not reach the conveyance surface of conveyance belt 121B (second case). However, depending on the basis weight and the type of the sheet, when an intermediate portion of the sheet makes contact with the second sheet when deflected in a direction toward the second sheet (that is, downward direction), the sheet may be deflected in a direction opposite to the second sheet (that is, upward direction).

The method for deflecting an intermediate portion of the sheet into the space includes a method in which conveyance belt 121B on the downstream side is moved with downstream conveyance belt 121A stopped as illustrated in FIG. 14. Alternatively, another method illustrated in FIG. 15 may also be adopted in which downstream conveyance belt 121A is moved at a predetermined speed and upstream side travelling of conveyance belt 121B is moved at a speed higher than the speed of downstream conveyance belt 121A. In the methods in FIG. 14 and FIG. 15, after predetermined deflection of an intermediate portion of a sheet is formed, downstream conveyance belt 121A is moved at a speed identical to that of upstream conveyance belt 121B. In this manner, the sheet is conveyed with the deflected shape of the intermediate portion of the sheet maintained, and thus overlapped-sheets feeding can be prevented from occurring.

Modification 5

Figure 16:
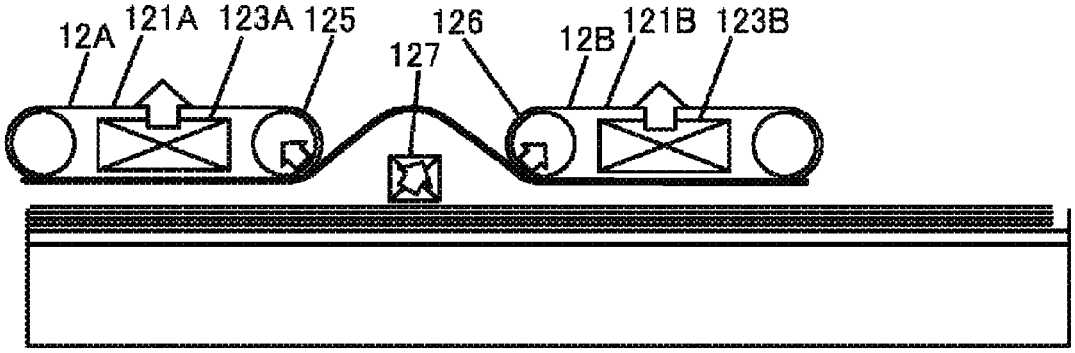
FIG. 16 schematically illustrates the sheet feed unit according to modification 5.
Figure 17:
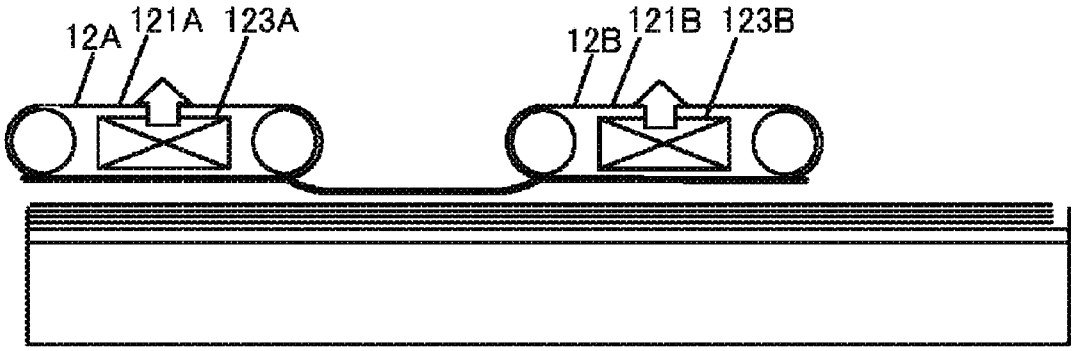
FIG. 17 illustrates a sheet sucked on both of an upstream side conveyance belt and a downstream side conveyance belt.

FIG. 16 schematically illustrates sheet feed units 10A to 10C according to modification 5. In the sheet feeding process, when the first (uppermost) sheet is sucked on conveyance belts 121A and 121B with air absorption sections 123A and 123B, the first sheet may possibly hang in a direction toward the second sheet (that is, downward direction) (see FIG. 17). When, in such a hanging state, control section 100 controls suction conveyance sections 12A and 12B to move conveyance belt 121B at a speed higher than that of conveyance belt 121A as described in modification 4, the intermediate portion of the first sheet is deflected in a direction toward the second sheet (downward direction), and the separation of the sheet is reduced. The deflection of the intermediate portion of the first sheet in a direction toward the second sheet (downward direction) can be prevented by controlling, by control section 100, suction conveyance sections 12A and 12B such that the intermediate portion of the first sheet is deflected in advance in the space in a direction opposite to the second sheet (that is, upward direction) before conveyance belt 121B is moved at a speed higher than that of conveyance belt 121A.

In modification 5, to preliminarily deflect the intermediate portion of the first sheet upward in the space, any of the following devices is provided. The first device is an air absorption section which sucks a sheet to a curved part wound around roller 125 in conveyance belt 121A (only the air absorption direction is illustrated in FIG. 16). The second device is an air absorption section which sucks a sheet to a curved part wound around roller 126 in conveyance belt 121B (only the air absorption direction is illustrated in FIG. 16). The third device is blowing section 127 which applies air jet in a substantially horizontal direction substantially orthogonal to the sheet conveyance direction. It is to be noted that the above-mentioned first to third devices may be used in combination. In addition, air blow ports 114*a* and 115*a* (see FIG. 3) may be used as blowing section 127.

While the embodiment of the present invention has been described in detail, the embodiment of the present invention is not limited to the above-mentioned configurations. For example, control section 100 may determine the hardness of the sheet on the basis of the basis weight and the type of the sheet (for example, plain paper, coated paper) included in sheet feeding information sent from image forming apparatus 20 to, on the basis of the hardness of the sheet, adjust the deflecting amount of an intermediate portion of a sheet by suction conveyance sections 12A and 12B. For example, in the case where the sheet is hard, the amount of hanging is slight, and therefore it is not necessary to deflect the sheet. Further, when an end portion of a sheet protrudes from the conveyance surface of conveyance belt 121B to the upstream side in the sheet conveyance direction, control section 100 may control suction conveyance sections 12A and 12B to adjust the deflecting amount of an intermediate portion of a sheet in accordance with the protruding amount. By increasing the deflecting amount, the protruding amount is reduced, and the total area of sheet hanging is reduced. Consequently, overlapped-sheets feeding can be prevented from occurring.

While suction conveyance section 12A is disposed on the downstream side in the sheet conveyance direction, and suction conveyance section 12B is disposed on the upstream side in the sheet conveyance direction in the above-described embodiment, the present invention is not limited to this configuration. For example, three or more suction conveyance sections may be disposed in a range from the upstream side to the downstream side. By increasing the number of the suction conveyance sections in accordance with the sheet length, the total area of the sheet hanging can be reduced.

The embodiments disclosed herein are merely exemplifications and should not be considered as limitative. While the invention made by the present inventor has been specifically described based on the preferred embodiments, it is not intended to limit the present invention to the above-mentioned preferred embodiments but the present invention may be further modified within the scope and spirit of the invention defined by the appended claims.

REFERENCE SIGNS LIST

1 Image formation system
10 Sheet feeding apparatus
11 Sheet storage section
12, 12A, 12B Suction conveyance section
100 Control section
121A, 121B Conveyance belt
123A, 123B Air absorption section
181 Sheet height detection section
182 Conveyance state detection section
183 Sheet detection section

What is claimed is:

1. A sheet feeding apparatus comprising:

a sheet storage section configured to store a plurality of sheets;

a first conveyance belt on which to suck the sheet stored in the sheet storage section, the first conveyance belt being disposed above the sheet storage section and configured to convey the sucked sheet in a sheet conveyance direction;

a first absorption section configured to absorb the sheet stored in the sheet storage section to suck the sheet on the first conveyance belt;

a second conveyance belt on which to suck the sheet stored in the sheet storage section, the second conveyance belt being disposed above the sheet storage section on an upstream side of the first conveyance belt in the sheet conveyance direction, and configured to convey the sucked sheet in the sheet conveyance direction;

a second absorption section configured to absorb the sheet stored in the sheet storage section to suck the sheet on the second conveyance belt; and a control section configured to perform a stopping operation for stopping at least one of a conveyance operation of the second conveyance belt and an absorption operation of the second absorption section during a conveyance operation of the first conveyance belt, wherein a space is provided between the first conveyance belt and the second conveyance belt in the sheet conveyance direction; and, after the sheet is sucked on the first conveyance belt by the first absorption section and the sheet is sucked on the second belt by the second absorption section, the control section performs an operation for setting a conveyance speed of the second conveyance belt to a speed higher than a conveyance speed of the first conveyance belt such that the sheet is deflected in the space.

2. The sheet feeding apparatus according to claim 1, wherein the control section performs the stopping operation when a rear end of the sheet passes through a position of a front end of the second conveyance belt in the sheet conveyance direction.

3. The sheet feeding apparatus according to claim 2 further comprising: a sheet rear end detection section configured to detect whether the rear end of the sheet passes through the position of the front end of the second conveyance belt, wherein the control section performs the stopping operation when the sheet rear end detection section detects that the rear end of the sheet passes through the position of the front end of the second conveyance belt.

4. The sheet feeding apparatus according to claim 2, wherein the control section performs the stopping operation when the control section determines that the rear end of the sheet passes through the position of the front end of the second conveyance belt based on a length of the sheet and a sending time of the sheet by the second conveyance belt.

5. The sheet feeding apparatus according to claim 1, wherein a length of a conveyance surface of the second conveyance belt in the sheet conveyance direction is equal to or smaller than a length of a conveyance surface of the first conveyance belt in the sheet conveyance direction.

6. The sheet feeding apparatus according to claim 1, wherein the control section moves the second conveyance belt and the second absorption section in accordance with a length of the sheet stored in the sheet storage section.

7. The sheet feeding apparatus according to claim 1, wherein the first conveyance belt includes a first curved part configured to protrude to the space side at a predetermined curvature, and the second conveyance belt includes a second curved part configured to protrude to the space side at a predetermined curvature, the sheet feeding apparatus further comprising:

a third absorption section configured to absorb the sheet conveyed in the space to suck the sheet on the first curved part; and a fourth absorption section configured to absorb the sheet conveyed in the space to suck the sheet on the second curved part.

8. The sheet feeding apparatus according to claim 1 further comprising a blowing section configured to apply air to the sheet to deflect the sheet in the space.

9. The sheet feeding apparatus according to claim 8, wherein the blowing section applies the air in a horizontal direction orthogonal to the sheet conveyance direction.

10. The sheet feeding apparatus according to claim 1, wherein the control section performs the operation for setting the conveyance speed of the second conveyance belt to a speed higher than the conveyance speed of the first conveyance belt such that a deflection amount of the sheet in the space is changed in accordance with a length of the sheet stored in the sheet storage section.

11. The sheet feeding apparatus according to claim 1, wherein the control section performs the operation for setting the conveyance speed of the second conveyance belt to a speed higher than the conveyance speed of the first conveyance belt such that a deflection amount of the sheet in the space is changed in accordance with a type of the sheet stored in the sheet storage section.

12. An image formation system comprising:

the sheet feeding apparatus according to claim 1; and an image forming apparatus connected with the sheet feeding apparatus and configured to form an image on a sheet fed from the sheet feeding apparatus.

13. A sheet feeding method comprising:

storing a plurality of sheets in a sheet storage section;

absorbing by a first absorption section the sheet stored in the sheet storage section to suck the sheet on a first conveyance belt;

absorbing by a second absorption section the sheet stored in the sheet storage section to suck the sheet on the second conveyance belt disposed on an upstream side of the first conveyance belt in the sheet conveyance direction;

conveying by the first conveyance belt and the second conveyance belt the sheet sucked on the first conveyance belt and the second conveyance belt in the sheet conveyance direction; and stopping at least one of a conveyance operation of the second conveyance belt and an absorption operation of the second absorption section during a conveyance operation of the first conveyance belt, wherein the step of conveying further comprising setting the conveyance speed of the second conveyance belt to a speed higher than a conveyance speed of the first conveyance belt so that the sheet sucked on the first conveyance belt and the second conveyance belt is deflected in a space between the first conveyance belt and the second conveyance belt.

* * * * *